US011511897B2

(12) United States Patent
Goserud

(10) Patent No.: US 11,511,897 B2
(45) Date of Patent: Nov. 29, 2022

(54) ASSEMBLY JIG FOR STACKED AND SHRINK WRAPPED GOLF BALLS

(71) Applicant: J. Thomas Goserud, Landisville, PA (US)

(72) Inventor: J. Thomas Goserud, Landisville, PA (US)

( * ) Notice: Subject to any disclaimer, the term of this patent is extended or adjusted under 35 U.S.C. 154(b) by 434 days.

(21) Appl. No.: 16/743,943

(22) Filed: Jan. 15, 2020

(65) Prior Publication Data

US 2020/0231316 A1 Jul. 23, 2020

Related U.S. Application Data

(60) Provisional application No. 62/795,108, filed on Jan. 22, 2019.

(51) Int. Cl.

| | |
|---|---|
| ***B65B 35/50*** | (2006.01) |
| ***A63B 47/00*** | (2006.01) |
| ***A63B 53/02*** | (2015.01) |
| ***B65B 11/00*** | (2006.01) |
| ***B65B 53/02*** | (2006.01) |
| ***B65B 11/02*** | (2006.01) |
| ***B65B 67/08*** | (2006.01) |
| *A63B 57/30* | (2015.01) |

(52) U.S. Cl.
CPC ..... *B65B 35/50* (2013.01); *A63B 47/00* (2013.01); *B65B 11/004* (2013.01); *B65B 11/02* (2013.01); *B65B 53/02* (2013.01); *B65B 67/08* (2013.01); *A63B 57/353* (2015.10)

(58) Field of Classification Search
CPC ..... B65B 35/50; B65B 67/08; B65B 53/02; B65B 11/004; B65B 25/00; B65B 25/24; A63B 47/00; A63B 57/353; A63B 57/35; A63B 57/207; A63B 57/20; A63B 57/30; A63B 2209/08; A63B 2225/64
See application file for complete search history.

(56) References Cited

U.S. PATENT DOCUMENTS

| | | | | |
|---|---|---|---|---|
| 1,706,605 A * | 3/1929 | Haase | B65B 25/24 | 242/129 |
| 4,077,514 A * | 3/1978 | Kubokawa | B65D 7/20 | 294/142 |
| 4,993,548 A * | 2/1991 | Peterson | A63B 47/00 | 206/315.9 |
| 5,480,026 A * | 1/1996 | Darling | A63B 47/00 | 206/315.9 |
| 5,553,707 A * | 9/1996 | Lion | A45F 5/00 | 224/678 |

OTHER PUBLICATIONS

"An automation hole in one," Pat Reynolds, Jul. 31, 2005 https://www.packworld.com/machinery/primary-packaging/article/13339936/an-automation-hole-in-one (Year: 2005).*

* cited by examiner

*Primary Examiner* — Thomas M Wittenschlaeger
(74) *Attorney, Agent, or Firm* — Patent Law of Virginia, PLLC; Brian J. Teague; Steve O'Donnell

(57) ABSTRACT

An assembly jig comprises a platform, first and second parallel posts projecting from the platform, and a pillar projecting from the platform in a position equidistant from each of the posts and forward of an imaginary line between the posts such that the posts and the pillar are in a triangular arrangement. The pillar is shorter than the posts.

29 Claims, 8 Drawing Sheets

ASSEMBLY JIG FOR STACKED AND SHRINK WRAPPED GOLF BALLS

CROSS-REFERENCE TO RELATED APPLICATIONS

This application claims priority to U.S. Provisional Application Ser. No. 62/795,108, filed Jan. 22, 2019, the contents of which are incorporated herein by reference in its entirety.

FIELD OF THE INVENTION

This invention relates to assembly jigs.

BACKGROUND

An assembly jig is a device or mechanism used in manufacturing for the attachment, securement, and correct alignment of parts and modules. Assembly jigs are used in a variety of manufacturing processes in which repetitive steps need to be performed accurately.

BRIEF SUMMARY OF THE DISCLOSURE

In one embodiment of the invention, an assembly jig comprises a platform, first and second parallel posts projecting from the platform, and a pillar projecting from the platform in a position equidistant from each of the posts and forward of an imaginary line between the posts such that the posts and the pillar are in a triangular arrangement. The pillar is shorter than the posts.

The platform may be angled from horizontal such that the posts and the pillar are at a same angle from horizontal.

The platform may be selectively movable between a first position in which the posts and the pillar are non-vertical and a second position in which the posts and the pillar are vertical. The assembly jig may further comprise a base to selectively support the platform in either the first position or the second position. The base may be selectively rotatable about a vertical axis.

The assembly jig may further comprise a third post selectively movable between a first position in which the third post is further away from the pillar than are the first and second posts and a second position in which the pillar is centered among and equidistant from the first, second, and third posts. The assembly jig may further comprise an arm from which the third post projects, the arm being selectively movable to position the third post in either its first or second position. The arm from which the third post projects may be pivotably attached to the platform. Each of the first post, the second post, and the third post may have a lower portion having a larger diameter than its corresponding upper portion. Each of the first post and the second post may have a top portion above its corresponding upper portion, the top portion having a larger diameter than its corresponding upper portion.

The assembly jig may further comprise a boom having a holding portion, the boom selectively movable between a first position in which the holding portion is not positioned above the pillar and a second position in which the holding portion is positioned above the pillar. The boom may be selectively attachable to the third post. The holding portion may be at a lower height relative to the pillar when the boom is in its second position as compared to when the boom is in its first position. The holding portion may comprise a magnet embedded in or attached to a lower surface of the holding portion.

The assembly jig may further comprise a magnet embedded in or attached to a top surface of the pillar.

In an alternative embodiment of the invention, a method of assembling a novelty golf item comprises obtaining an assembly jig as described above, placing a poker chip golf ball marker on a top surface of the pillar, stacking a plurality of golf balls on a top surface of the ball marker such that each golf ball contacts the first and second posts, the plurality of golf balls comprising at least a bottom ball in contact with the ball marker and a top ball, placing a shrink-wrap sleeve over the plurality of golf balls and the ball marker, and applying heat to the sleeve to shrink the sleeve, thereby securing the ball marker and the plurality of golf balls together in a stacked arrangement.

The method may further comprise placing or ensuring that the platform is placed in its first position prior to stacking the golf balls on the top surface of the ball marker.

The method may further comprise placing or ensuring that the third post is placed in its first position prior to stacking the golf balls on the top surface of the ball marker, moving the third post to its second position after stacking the golf balls on the top surface of the ball marker, and moving the platform to its second position after moving the third post to its second position.

The method may further comprise placing or ensuring that the boom is placed in its first position, securing a second poker chip golf ball marker to the holding portion of the boom, and moving the boom to its second position such that the second ball marker is inserted into an open top end of the sleeve and contacts the top ball. Applying heat to the sleeve to shrink the sleeve may secure the first ball marker, the plurality of golf balls, and the second ball marker together in the stacked arrangement.

BRIEF DESCRIPTION OF THE SEVERAL VIEWS OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
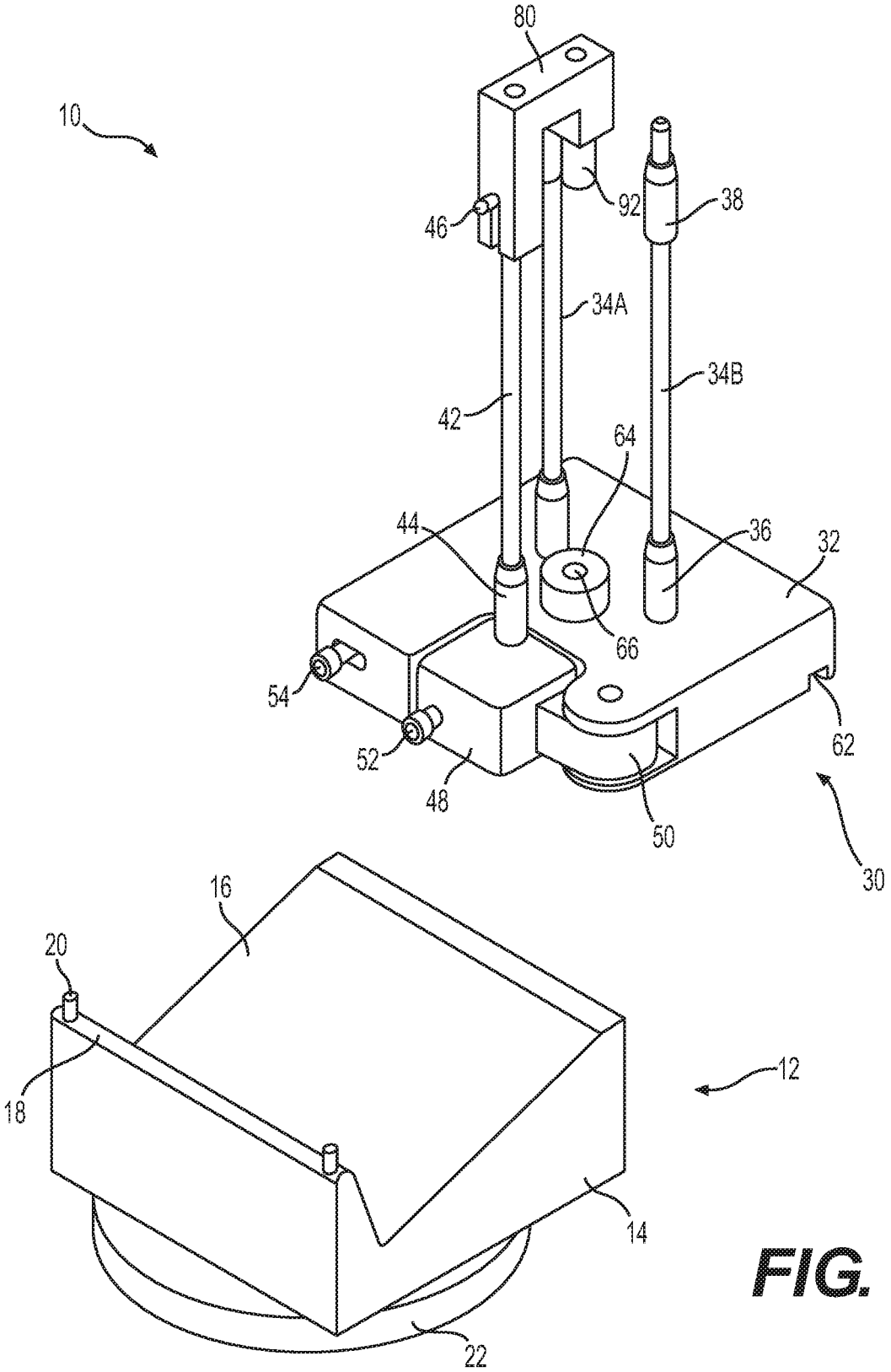
FIG. 1 is a perspective view of an assembly jig, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

A novelty golf item illustrated in co-pending, co-owned U.S. patent application Ser. No. 29/675,083, filed Dec. 28, 2018 (the contents of which are incorporated herein by reference in its entirety) contains two or more (typically three) golf balls stacked on top of a poker chip ball marker, shrink-wrapped together. A second poker chip ball marker may be stacked on top of the two or three golf balls, or a different decorative or functional item may be stacked on top. Because of the spherical shape of the golf balls, assembling such a novelty golf items can be difficult as the individual components need to be held in position for a shrink-wrap sleeve to be positioned over the components and activated by applying a heat gun or sending the assembly through a heat tunnel.

Embodiments of the invention are directed to an assembly jig for such a novelty golf item. The assembly jig holds the individual components in position for a shrink-wrap sleeve to be positioned over the components and activated (i.e., shrunk) by applying a heat gun to the sleeve or sending the assembly through a heat tunnel while the assembly is held by the jig.

Referring now to the figures, an assembly jig 10 may be used to assemble and shrink-wrap together a bottom poker chip golf ball marker 102, two or more golf balls 100, and optionally a top poker chip golf ball marker 104 or other decorative or functional item. The assembly jig 10 of embodiments of the invention comprises an assembly portion 30 and a base 12. The assembly portion 30 comprises a platform 32. The platform has a generally rectangular prism shape with a generally planar top surface, although other shapes are possible. A first post 34A and a second post 34B project upward from the top surface of the platform 32. The first post 34A and the second post 34B are substantially parallel to each other. A pillar 64 also projects from the top surface of the platform 32 in a position equidistant from each of the posts 34A, 34B and forward of an imaginary line between the posts 34A, 34B such that the posts 34A, 34B and the pillar 64 are in a triangular arrangement. The pillar 64 is substantially shorter than the posts 34A, 34B. The pillar 64 may be height adjustable, such as via a set screw (not illustrated) accessible via a channel 68 in a side surface of the platform 32 (however, any suitable height adjustment mechanism may be used). A magnet 66 may be embedded in or attached to a top surface of the pillar 64. Such a magnet 66 holds the poker chip golf ball marker 102, which contains a ferrous metal, in place during assembly.

Figure 2:
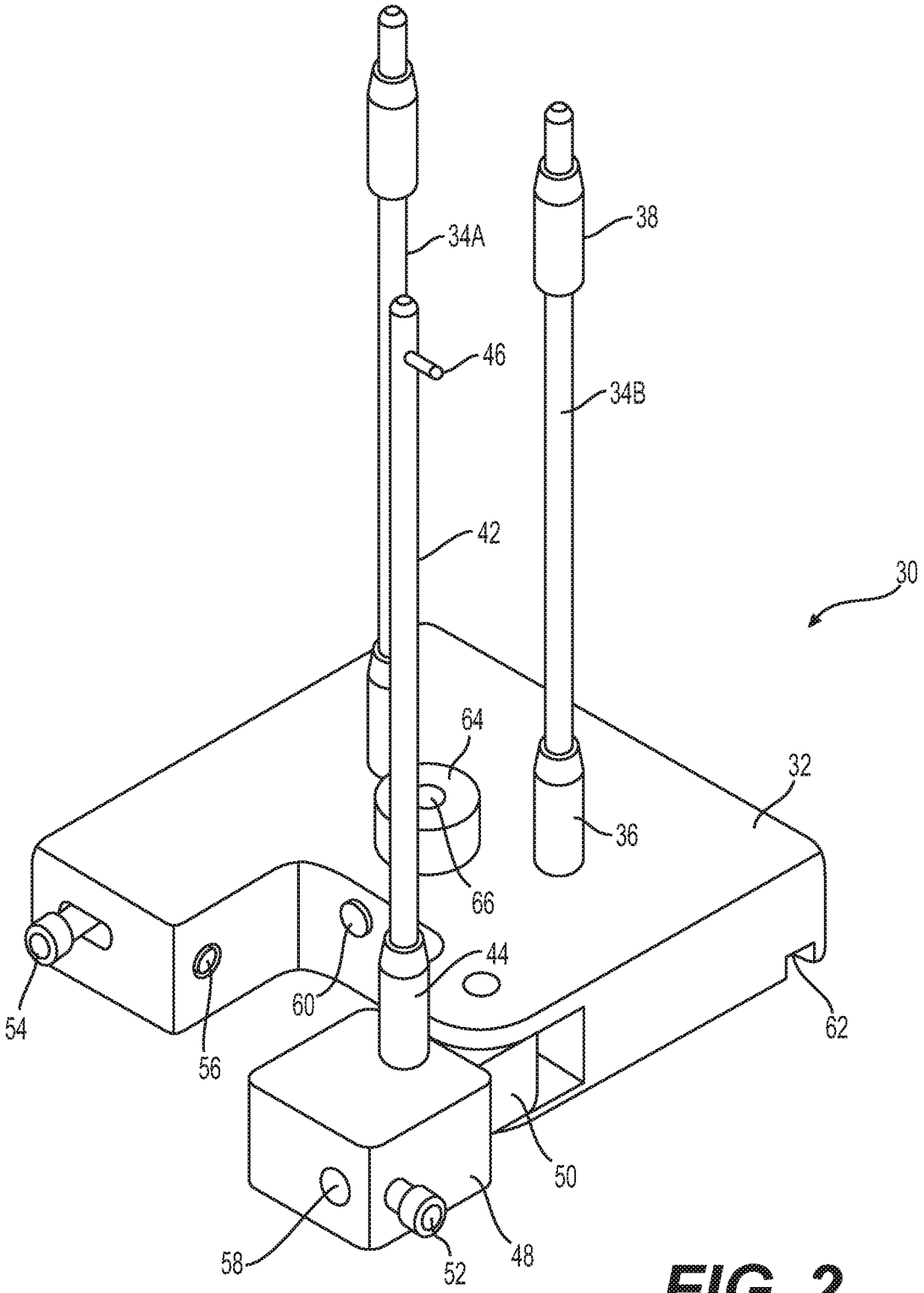
FIG. 2 is a perspective view of an assembly portion of the assembly jig of FIG. 1.

The assembly portion 30 further comprises a third post 42 that is selectively movable between a first position (shown in FIGS. 2 and 3) in which the third post 42 is further away from the pillar 64 than are the first and second posts 34A, 34B and a second position (shown in FIGS. 1 and 4-7) in which the pillar 64 is centered among and equidistant from the first, second, and third posts 34A, 34B, 42. The third post 42 projects upward from an arm 48 that is selectively movable to position the third post in either its first position or its second position. The arm 48 is pivotably attached to the platform 32 via hinge 50. A handle 52 enables the arm 48 to be readily moved between positions. A magnet 60 on the platform 32 attracts a ferrous plate 58 on the arm 48 to help hold the arm 48 in the second position. (Alternatively, a ferrous plate on the platform may attract a magnet on the arm.) A latch may be used to hold the arm 48 more securely in the second position. The illustrated latch comprises a handle 54 that slides a bar 56 within a channel 70 to engage a corresponding hole 58 on the arm 48; however, any suitable latching or securing mechanism may be used.

As is discussed in detail below, the pillar 64, the first post 34A, the second post 34B, and the third post 42 work together to position and hold the ball marker(s) and golf balls during assembly. Because the ball marker(s) have a smaller diameter than the golf balls, the posts in the illustrated embodiment have a larger diameter bottom portion 36 (for the first and second posts), 44 (for the third post) to properly position the bottom ball marker 102 and a larger diameter top portion 38 (typically only the first and second posts need have the larger diameter top portion, which may be height adjustable via set screws 40) to properly position the top ball marker 104 (if present). The goal is for the centers of the ball marker(s) and golf balls to be aligned along the same central axis.

The assembly portion 30 further comprises a boom 80. The boom 80 has an ascending portion 82, a transverse portion 88, and a descending portion 90 such that the boom 80 is generally shaped as an upside down J or U. The ascending portion 82 has an elongated generally cylindrical cavity 84 with an opening on the bottom surface of the ascending portion 82, and an elongated channel 86 defined in a side surface that opens into the cavity 84. At the lower end of the descending portion 90 is a holding portion 92 with a magnet 94 embedded in or attached to a lower surface of the holding portion 92. Such a magnet 94 holds the top poker chip golf ball marker 104, which contains a ferrous metal, in place during assembly. The boom 80 is selectively mountable onto the third post 42 by inserting the top end of the third post 42 into the cavity 84 of the boom 80. The boom 80 is selectively movable between a first position (shown in FIG. 5) in which the holding portion 92 is not positioned above the pillar 66 and a second position (shown in FIGS. 1, 6, and 7) in which the holding portion 92 is positioned above the pillar 66. The holding portion 92 is at a lower height relative to the pillar 66 when the boom 80 is in its second position as compared to when the boom 80 is in its first position. The different heights of the boom 80 in the different positions are enabled by the pin 46 projecting perpendicularly from the third post 42. When the boom 80 is rotationally positioned such that the pin 46 does not engage the channel 86, the pin 46 holds the boom 80 at a relatively higher position (shown in FIG. 5). When the boom 80 is rotationally positioned such that the pin 46 does engage the channel 86, the pin 46 holds the boom 80 at a relatively lower position (shown in FIG. 1).

The assembly jig of the illustrated embodiment includes a base 12 upon which the assembly portion 30 may be selectively positioned. The base 12 comprises a main body 14 rotatably affixed to a foot 22. In use, the foot 22 sits upon a work surface such as a workbench. The main body 14 can be freely rotated relative to the foot 22. In this regard, the assembly portion 30 may also be freely rotated relative to the foot 22 when the assembly portion 30 sits upon the base 12. The main body comprises a sloped surface 16, a raised ledge 18 on the lower end of the sloped surface 16, and pins 20 at opposing ends of the top surface of the raised ledge 18.

Figure 3:
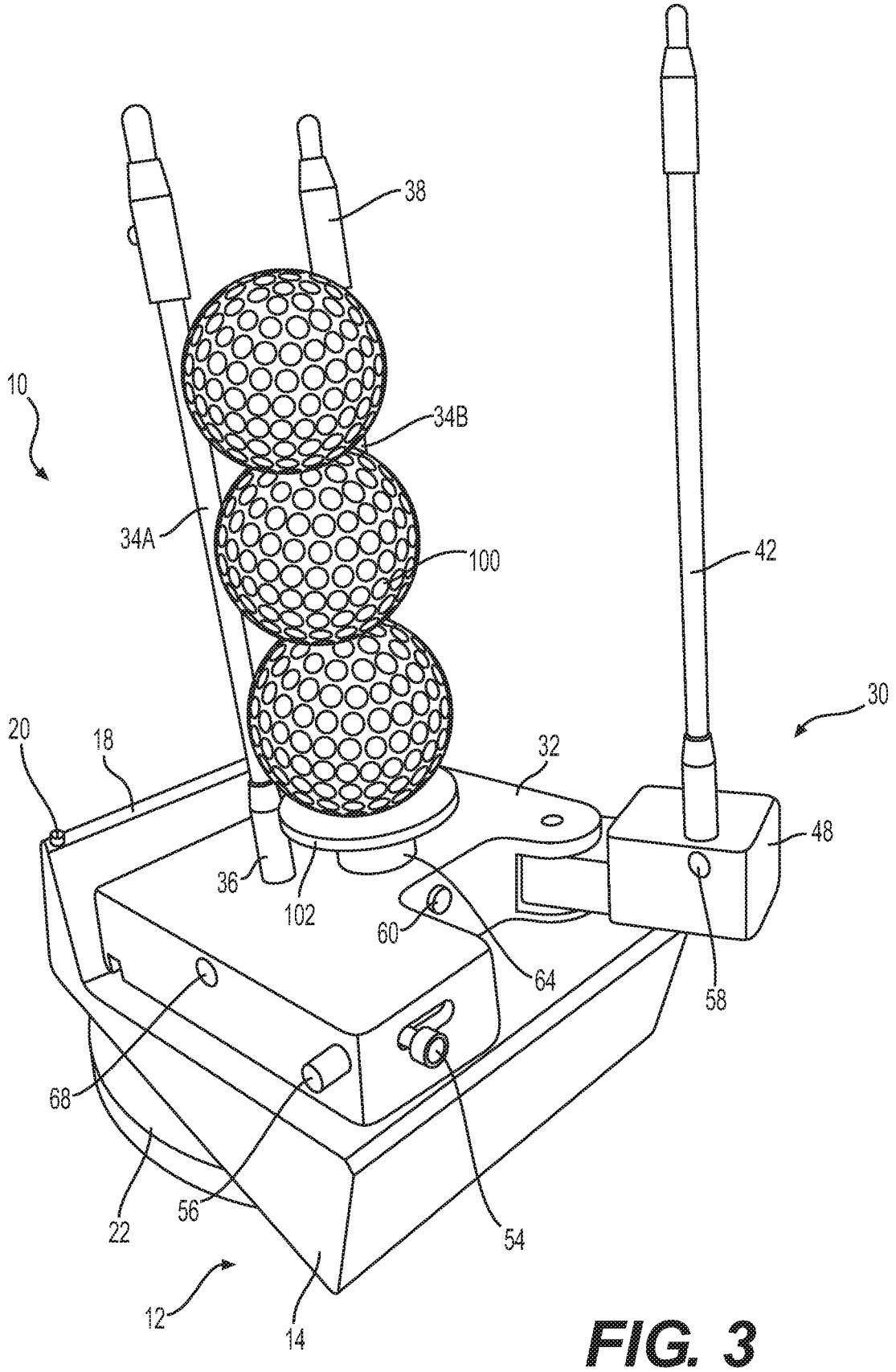
FIG. 3 is a perspective view of the assembly jig of FIG. 1, in use.

In one embodiment of the invention (not illustrated), an assembly jig may be fixed in a position that is angled from vertical. That is, the first and second posts and the pillar would all be at a same angle from vertical, with the first and second posts being lower than the pillar (similar to FIG. 3, but without necessarily having a rotatable base as shown in FIG. 3). Such an embodiment would likely not require a third post, as the fixed angle of the first and second posts enables gravity to keep the golf balls in position during assembly.

In other embodiments of the invention, one or more portions of the assembly jig may be selectively movable between a first position in which the posts and the pillar are non-vertical and a second position in which the posts and the pillar are vertical. In the illustrated embodiment, the platform 32 is selectively movable between a first position in which the posts and the pillar are non-vertical and a second position in which the posts and the pillar are vertical. This is enabled by the base 12 which selectively supports the platform (and therefore the entire assembly portion 30) in either the first position (shown in FIG. 3) or the second position (shown in FIGS. 5-7). In the first position, the platform 32 sits down on the angled surface 16 of the base 12. In the second position, one end of the platform 32 sits up on the raised ledge 18 between the pins 20 such that a channel 62 in a bottom surface of the platform 32 engages the raised ledge 18. The engagement between the channel 62 and the raised ledge 18, along with the pins 20, helps maintain the assembly portion 30 in the second position.

Figure 4:
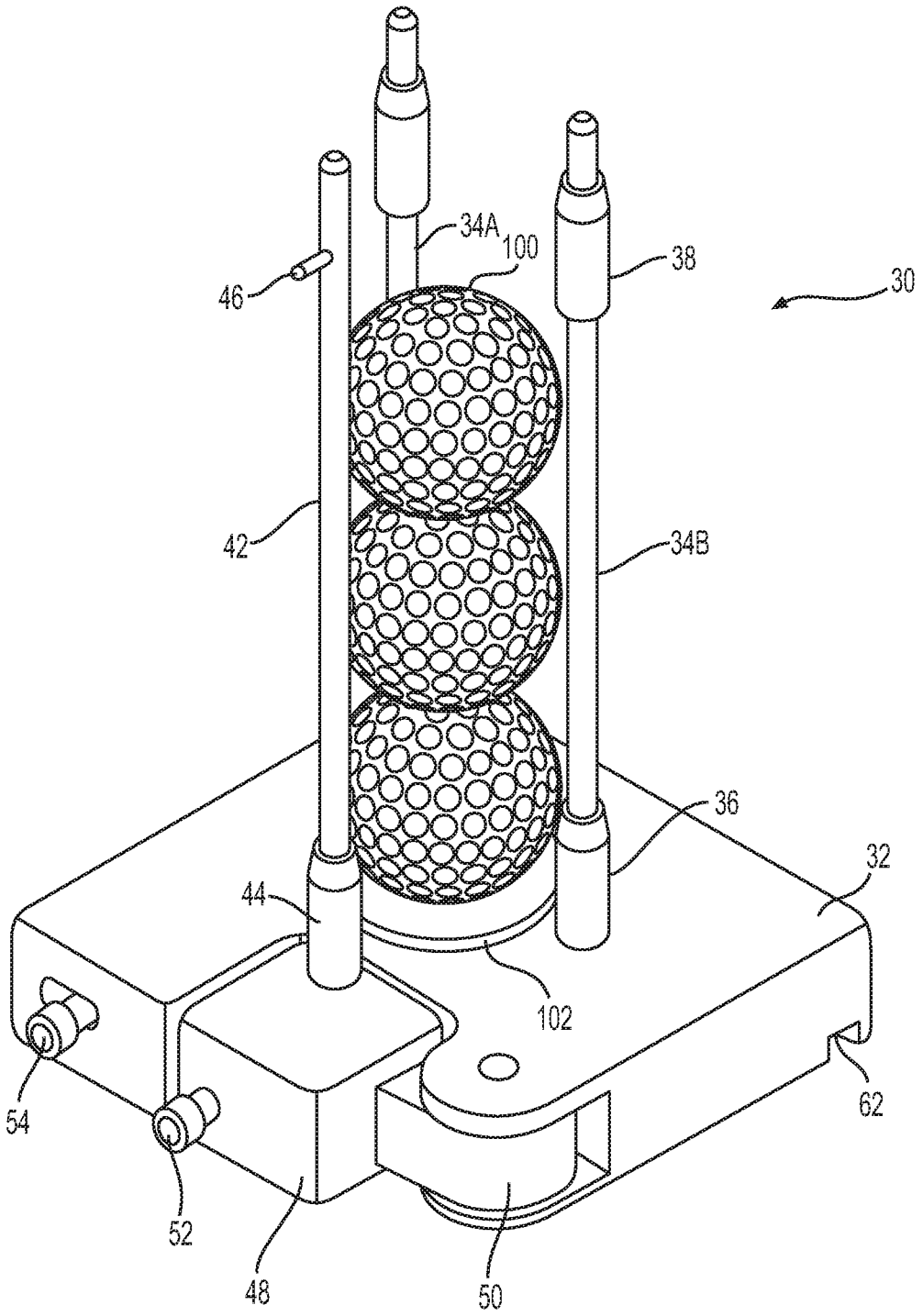
FIG. 4 is a perspective view of the assembly portion of the assembly jig of FIG. 1, in use.
Figure 5:
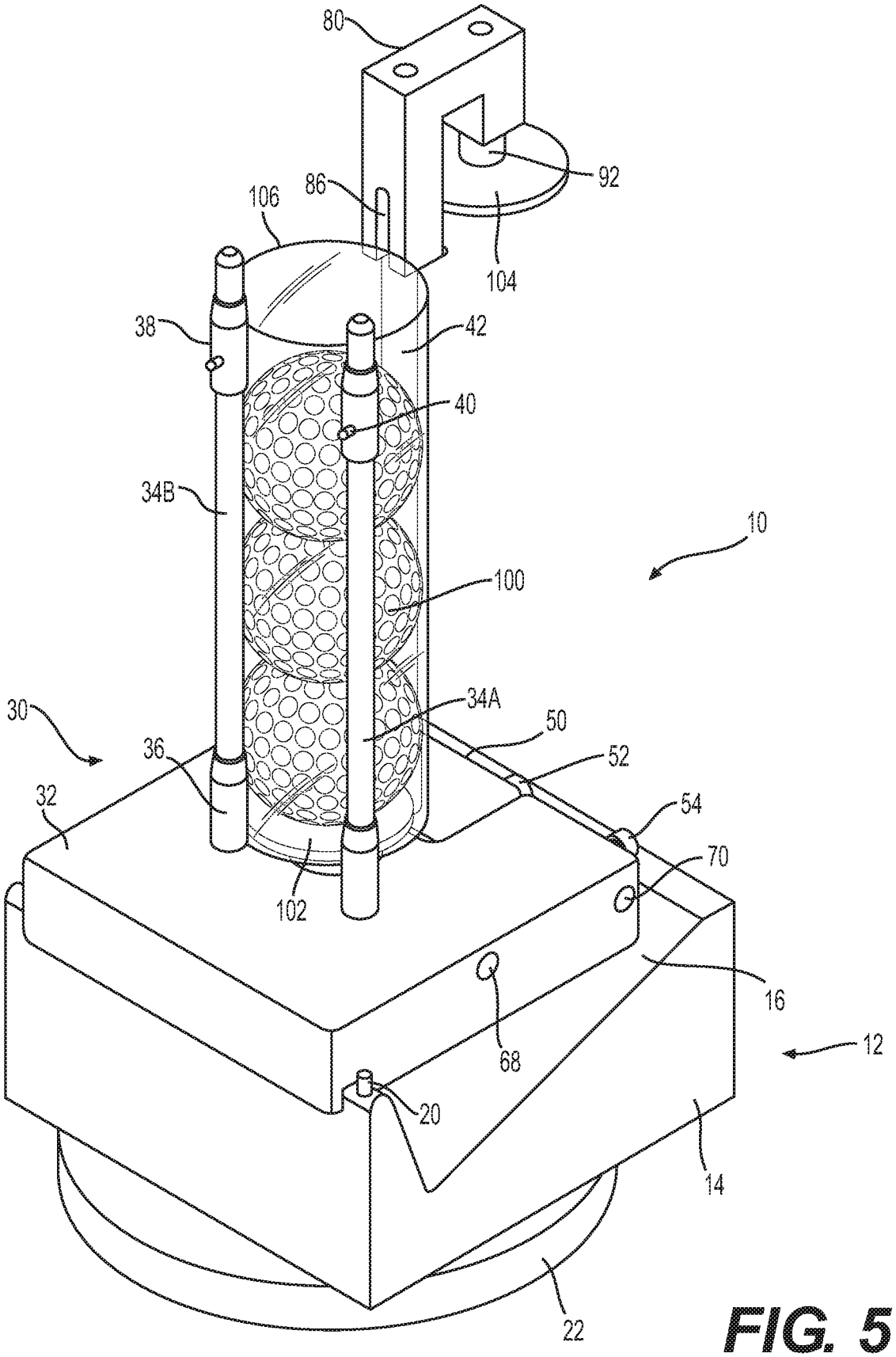
FIGS. 5-7 are perspective views of the assembly jig of FIG. 1, in use.
Figure 6:
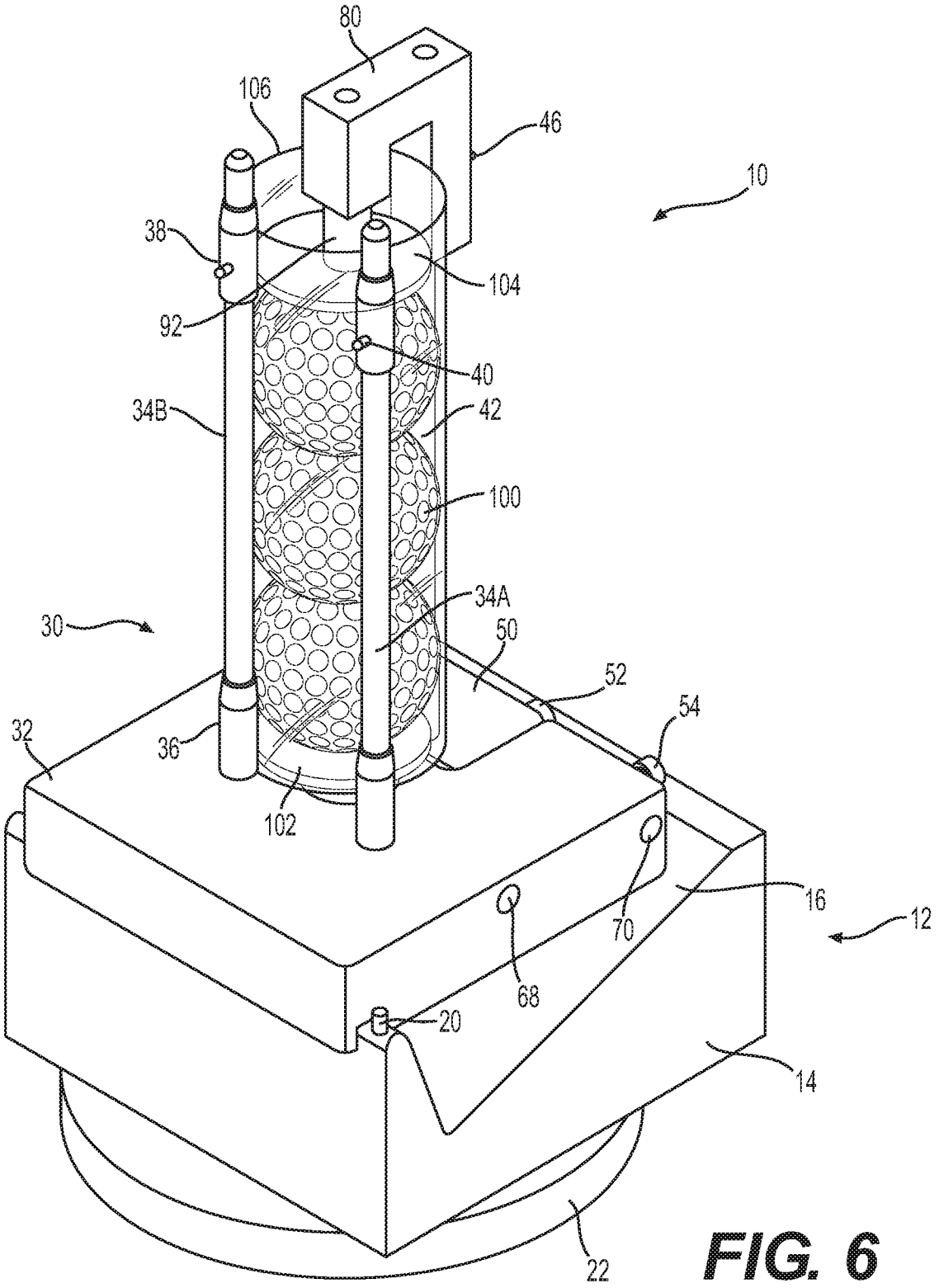
Figure 7:
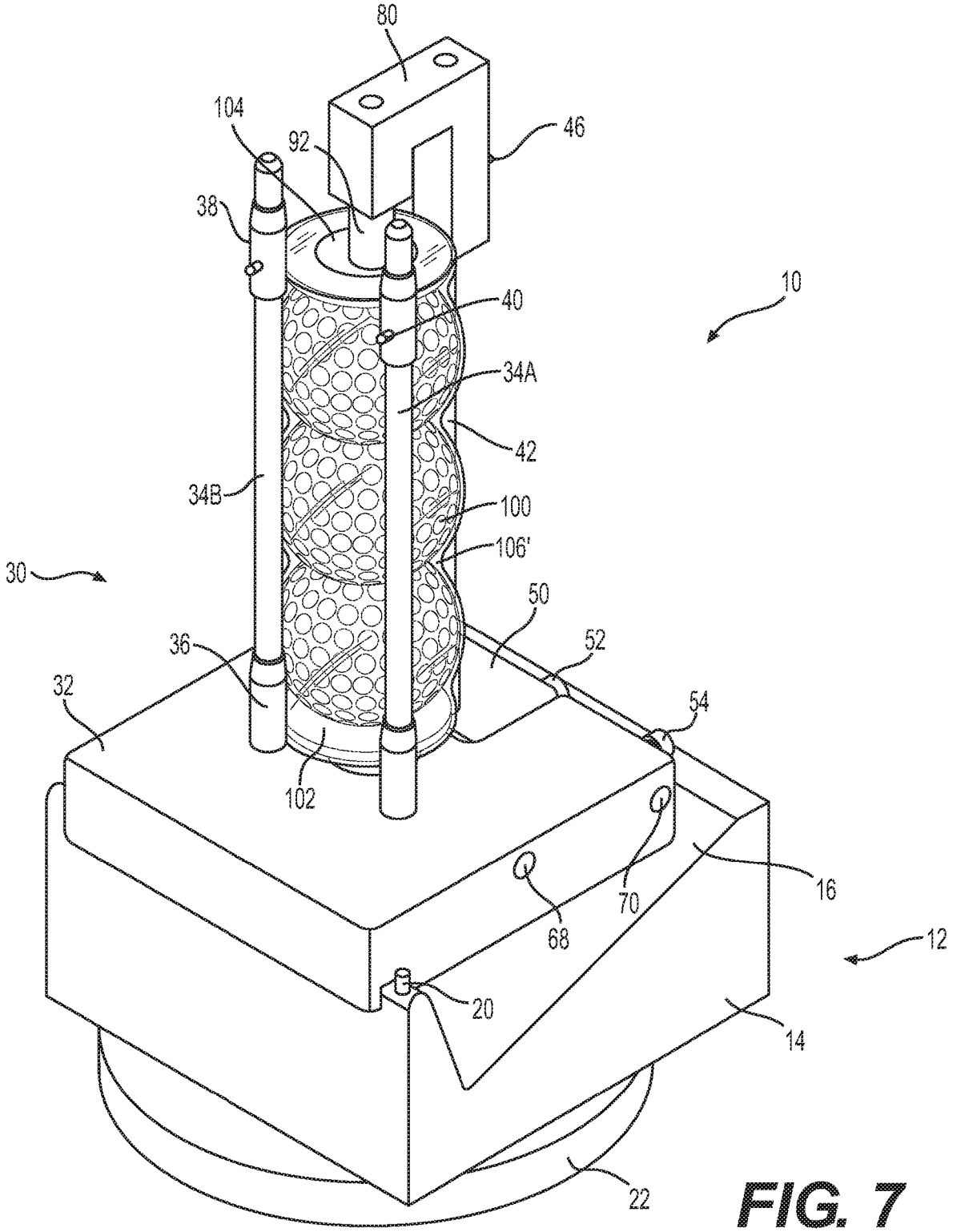
Figure 8:
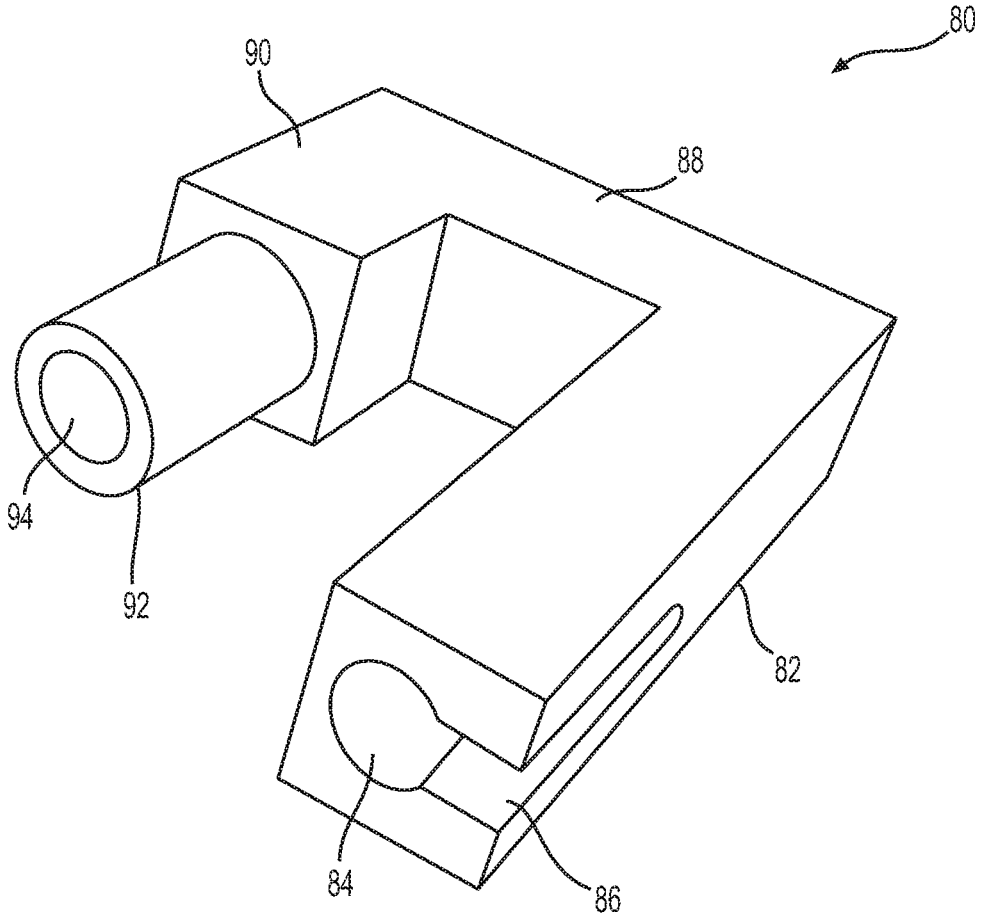
FIG. 8 is a perspective view of a top chip support arm of the assembly portion of the assembly jig of FIG. 1.

Embodiments of the invention are further directed to a method of assembling a novelty golf item as described above. In one embodiment of the invention, a method of assembling a novelty golf item comprises obtaining an assembly jig, such as the assembly jig 10 described above; placing or ensuring that the platform 32 is placed in its first position as shown in FIG. 3; placing or ensuring that the third post 42 is placed in its first position as shown in FIG. 3; placing a poker chip golf ball marker 102 on a top surface of the pillar 64; stacking a plurality of golf balls 100 on a top surface of the ball marker 102 such that each golf ball contacts the first and second posts 34A, 34B; moving the third post 42 to its second position as shown in FIG. 4; moving the platform 32 to its second position as shown in FIGS. 5-7; placing a shrink-wrap sleeve 106 over the plurality of golf balls 100 and the ball marker 102; and applying heat to the sleeve 106 to shrink the sleeve (shrunken sleeve 106' is shown in FIG. 7), thereby securing the ball marker and the plurality of golf balls together in a stacked arrangement. Heat may be applied by a heat gun to the sleeve 106 while the arrangement is held in the jig or by sending the entire assembly jig 10 (or the assembly portion 30 removed from the base 12) through a heat tunnel.

If the stacked arrangement is to include a top ball marker 104 (as illustrated), the following steps are performed prior to applying heat to the sleeve 106: placing or ensuring that the boom 80 is placed in its first position as shown in FIG. 5; securing a second poker chip golf ball marker 104 to the holding portion 92 of the boom 80; and moving the boom 80 to its second position (shown in FIG. 6) such that the second ball marker 104 is inserted into an open top end of the sleeve and contacts the top ball, such that applying heat to the sleeve 106 to shrink the sleeve 106 secures the first ball marker 102, the plurality of golf balls 100, and the second ball marker 104 together in the stacked arrangement.

In another embodiment of the invention, a method of assembling a novelty golf item may use a simpler assembly jig that has only one position in which the pillar and posts are angled from vertical. In such an embodiment of the invention, a method of assembling a novelty golf item comprises placing a poker chip golf ball marker on a top surface of the pillar; stacking a plurality of golf balls on a top surface of the ball marker such that each golf ball contacts the posts; placing a shrink-wrap sleeve over the plurality of golf balls and the ball marker; inserting a second ball marker (if desired) or other component into the open top end of the sleeve; and applying heat to the sleeve to shrink the sleeve, thereby securing the ball marker(s) and the plurality of golf balls together in a stacked arrangement.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. An assembly jig comprising:

a platform;

first and second parallel posts projecting from the platform;

a pillar projecting from the platform in a position equidistant from each of the posts and forward of an imaginary line between the posts such that the posts and the pillar are in a triangular arrangement, the pillar being shorter than the posts; and a third post selectively movable between a first position in which the third post is further away from the pillar than are the first and second posts and a second position in which the pillar is centered among and equidistant from the first, second, and third posts.

2. The assembly jig of claim 1, wherein the platform is angled from horizontal such that the posts and the pillar are at a same angle from horizontal.

3. The assembly jig of claim 1, wherein the platform is selectively movable between a first position in which the posts and the pillar are non-vertical and a second position in which the posts and the pillar are vertical.

4. The assembly jig of claim 3, further comprising a base to selectively support the platform in either the first position or the second position.

5. The assembly jig of claim 4, wherein the base is selectively rotatable about a vertical axis.

6. The assembly jig of claim 1, further comprising an arm from which the third post projects, the arm being selectively movable to position the third post in either its first or second position.

7. The assembly jig of claim 6, wherein the arm from which the third post projects is pivotably attached to the platform.

8. The assembly jig of claim 1, wherein each of the first post, the second post, and the third post have a lower portion having a larger diameter than its corresponding upper portion.

9. The assembly jig of claim 8, wherein each of the first post and the second post have a top portion above its corresponding upper portion, the top portion having a larger diameter than its corresponding upper portion.

10. The assembly jig of claim 1, further comprising a boom having a holding portion, the boom selectively movable between a first position in which the holding portion is not positioned above the pillar and a second position in which the holding portion is positioned above the pillar.

11. The assembly jig of claim 10, wherein the boom is selectively attachable to the third post.

12. The assembly jig of claim 10, wherein the holding portion is at a lower height relative to the pillar when the boom is in its second position as compared to when the boom is in its first position.

13. The assembly jig of claim 10, wherein the holding portion comprises a magnet embedded in or attached to a lower surface of the holding portion.

14. The assembly jig of claim 1, further comprising a magnet embedded in or attached to a top surface of the pillar.

15. A method of assembling a novelty golf item, the method comprising:

obtaining an assembly jig, the assembly jig comprising:

(a) a platform;

(b) first and second parallel posts projecting from the platform; and (c) a pillar projecting from the platform in a position equidistant from each of the posts and forward of an imaginary line between the posts such that the posts and the pillar are in a triangular arrangement, the pillar being shorter than the posts;

placing a poker chip golf ball marker on a top surface of the pillar;

stacking a plurality of golf balls on a top surface of the ball marker such that each golf ball contacts the first and second posts, the plurality of golf balls comprising at least a bottom ball in contact with the ball marker and a top ball;

placing a shrink-wrap sleeve over the plurality of golf balls and the ball marker; and applying heat to the sleeve to shrink the sleeve, thereby securing the ball marker and the plurality of golf balls together in a stacked arrangement.

16. The method of claim 15, wherein the platform is angled from horizontal such that the posts and the pillar are at a same angle from horizontal.

17. The method of claim 15, wherein the platform is selectively movable between a first position in which the posts and the pillar are non-vertical and a second position in which the posts and the pillar are vertical; and wherein the method further comprises placing or ensuring that the platform is placed in its first position prior to stacking the golf balls on the top surface of the ball marker.

18. The method of claim 17, wherein the assembly jig further comprises a base to selectively support the platform in either the first position or the second position.

19. The method of claim 18, wherein the base is selectively rotatable about a vertical axis.

20. The method of claim 17, wherein the assembly jig further comprises a third post selectively movable between a first position in which the third post is further away from the pillar than are the first and second posts and a second position in which the pillar is centered among and equidistant from the first, second, and third posts; and wherein the method further comprises:

placing or ensuring that the third post is placed in its first position prior to stacking the golf balls on the top surface of the ball marker;

moving the third post to its second position after stacking the golf balls on the top surface of the ball marker; and moving the platform to its second position after moving the third post to its second position.

21. The method of claim 20, wherein the assembly jig further comprises an arm from which the third post projects, the arm being selectively movable to position the third post in either its first or second position.

22. The method of claim 21, wherein the arm from which the third post projects is pivotably attached to the platform.

23. The method of claim 20, wherein each of the first post, the second post, and the third post have a lower portion having a larger diameter than its corresponding upper portion.

24. The method of claim 23, wherein each of the first post and the second post have a top portion above its corresponding upper portion, the top portion having a larger diameter than its corresponding upper portion.

25. The method of claim 20, wherein the assembly jig further comprises a boom having a holding portion, the boom being selectively movable between a first position in which the holding portion is not positioned above the pillar and a second position in which the holding portion is positioned above the pillar;

wherein the poker chip golf ball marker is a first poker chip golf ball marker;

wherein the method further comprises:

placing or ensuring that the boom is placed in its first position;

securing a second poker chip golf ball marker to the holding portion of the boom; and moving the boom to its second position such that the second ball marker is inserted into an open top end of the sleeve and contacts the top ball; and wherein applying heat to the sleeve to shrink the sleeve secures the first ball marker, the plurality of golf balls, and the second ball marker together in the stacked arrangement.

26. The method of claim 25, wherein the boom is selectively attachable to the third post.

27. The method of claim 25, wherein the holding portion is at a lower height relative to the pillar when the boom is in its second position as compared to when the boom is in its first position.

28. The method of claim 25, wherein the holding portion comprises a magnet embedded in or attached to a lower surface of the holding portion, such that the second ball marker is secured to the holding portion of the boom via the holding portion magnet.

29. The method of claim 15, wherein the assembly jig further comprises a magnet embedded in or attached to a top surface of the pillar.

* * * * *